US006553922B1

(12) United States Patent
Lundblad et al.

(10) Patent No.: US 6,553,922 B1
(45) Date of Patent: Apr. 29, 2003

(54) SAFE FOR VALUABLE DOCUMENTS

(75) Inventors: Leif Lundblad, Stockholm (SE); Claes Björkman, Stockholm (SE)

(73) Assignee: Nybohov Development AB, Stockholm (SE)

( * ) Notice: Subject to any disclaimer, the term of this patent is extended or adjusted under 35 U.S.C. 154(b) by 0 days.

(21) Appl. No.: 09/831,891

(22) PCT Filed: Nov. 30, 1999

(86) PCT No.: PCT/SE99/02230

§ 371 (c)(1),
(2), (4) Date: May 23, 2001

(87) PCT Pub. No.: WO00/34612

PCT Pub. Date: Jun. 15, 2000

(30) Foreign Application Priority Data

Dec. 4, 1998 (SE) ..... 9804218

(51) Int. Cl.[7] ..... E05G 1/00; E05G 1/12; E05G 1/14

(52) U.S. Cl. ..... 109/25; 109/23; 109/29; 109/36; 109/38

(58) Field of Search ..... 109/23, 24, 24.1, 109/25, 26, 29, 31, 32, 33, 34, 36, 37, 41, 42, 45, 46, 47, 53, 54, 55, 56, 57

(56) References Cited

U.S. PATENT DOCUMENTS 4,363,279 A * 12/1982 Johansson ..... 109/20
4,729,327 A * 3/1988 Demonbreun ..... 109/35
4,785,743 A * 11/1988 Dalphin ..... 109/40
4,942,831 A * 7/1990 Tel ..... 109/25
5,156,272 A * 10/1992 Bouchard et al. ..... 109/25
5,406,896 A 4/1995 Jacobson ..... 109/29
5,537,938 A * 7/1996 Lopez, Jr. ..... 109/25
5,732,638 A * 3/1998 Van Lint ..... 109/29
5,787,819 A * 8/1998 Fumanelli ..... 109/25

FOREIGN PATENT DOCUMENTS

FR 2 550 364 2/1985
FR 2 594 169 8/1987

* cited by examiner

*Primary Examiner*—Anthony Knight
*Assistant Examiner*—Michael J. Kyle
(74) *Attorney, Agent, or Firm*—Jacobson Holman PLLC

(57) ABSTRACT

A safe for valuable documents having a shell protection around the safe for impeding attempts to force an entry thereinto and processor unit actuated in response to damage to the shell protection to initiate a safe protection function. The safe contains a plurality of units for accommodating documents, at least one of which includes a portable safe deposit box that, when placed in the safe, can be electrically connected thereto. The safe deposit box has a protective shell and a destructive device designed to effect local destruction of documents contained in the box. The destructive device operates automatically in response to damage to the protective shell when the safe deposit box is removed from the safe and an attempt is made to force the box open. However, when the safe deposit box is placed in and electrically connected to the safe, the destructive device operates in response to actuation of the processor unit such that the protective function of the box is then subordinated to the safe protection function.

11 Claims, 2 Drawing Sheets

SAFE FOR VALUABLE DOCUMENTS

FIELD OF INVENTION

The present invention relates to a safe and more specifically to a safe for the safe-keeping of valuable documents, such as banknotes, cheques, etc. The safe includes a plurality of units each intended for a plurality of valuable documents and the whole of the safe is protected to make attempts to force the safe difficult and/or to prevent such attempts being made.

DESCRIPTION OF THE BACKGROUND ART

It is known to use special safes for the safe-keeping of valuable documents, such as banknotes for instance. For natural reasons, such safes are often very heavy and difficult to handle, although this is not a sufficient deterrent on its own to prevent prospective thieves from forcing their way through the wall of a building with the aid of a lorry for instance and blowing open the safe on site or removing the safe to a secluded place and there avail themselves of its contents in peace and quiet.

It is also known to use specially designed security boxes or bags to transport large sums of money in the form of banknotes. Such bags, or boxes, are equipped in different ways with special protective devices which impede/make impossible attempts to force open the bag or box and retrieve its contents. This protective device may, for instance, consist of a used dye capsule/an explosive charge which is automaticlly activated when an attempt is made to force open the box, therewith rendering the banknotes more or less useless by staining/shredding the banknotes.

The object of the present invention is to eliminate the aforementioned drawbacks by providing a novel safe with which it is possible to successfully prevent or at least successfully impede stealing of valuable documents such as cheques, banknotes, etc. In many cases, knowledge of the properties of the safe may, in itself, deter presumptive criminals from any criminal action in the present context.

SUMMARY OF THE INVENTION

In accordance with the present invention, at least one unit in a safe of the aforedescribed kind comprises a moveable safe deposit box which within the safe can be connected to the safe and which is equipped with a so-called shell protective means and destructive means which is adapted to come into operation automatically when the safe deposit box is removed from the safe and an attempt is made to force open the box, in response to damage to said protective means, but which when the box is inserted and connected-up in the safe will function only in response to activation from a processor unit mounted in the safe, whereby the protective function of the safe deposit box is subordinated to the protective function of the safe subsequent to the box having been placed in the safe in the manner intended.

These and other characteristic features of an inventive safe will be apparent from the accompanying Claims.

BRIEF DESCRIPTION OF THE DRAWINGS

The invention will now be described in more detail with reference to the accompanying schematic drawings, in which.

DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
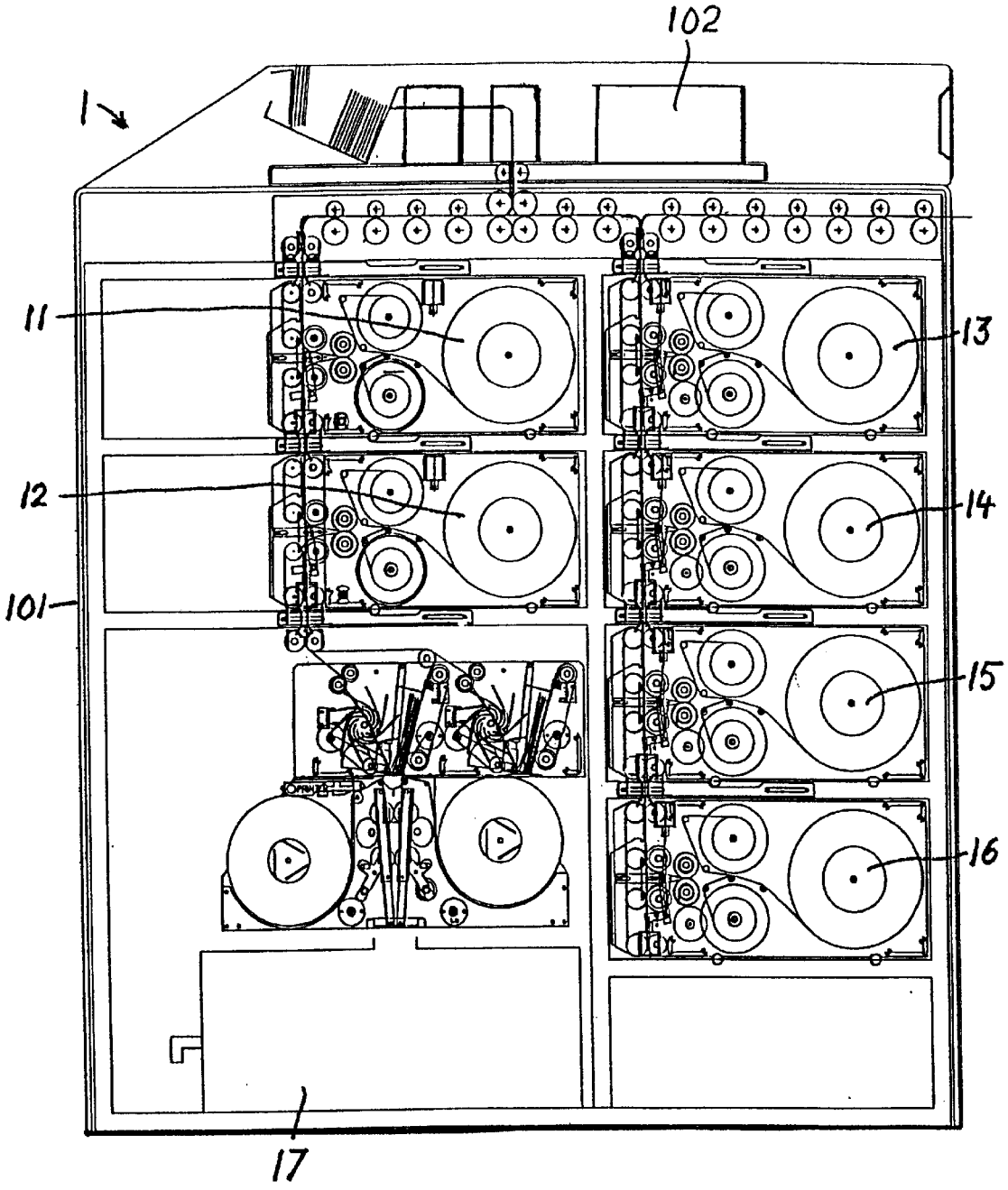
FIG. 1 illustrates an inventive safe that includes a plurality of units intended for a plurality of valuable documents.

The safe 1 illustrated in FIG. 1 is intended for the safe-keeping of valuable documents such as banknotes, cheques, etc., and includes a plurality of units 11–17 each of which is intended to accommodate a plurality of valuable documents. The safe as a whole includes a so-called safe shell protector 101 which functions to prevent/impede attempts to break open the safe.

At least one of said units 11–17, the unit 17 in the illustrated case, is comprised of a moveable (portable) safety deposit box or case (see FIG. 2) which can be placed in the safe 1 inwardly of the shell Drotector 101 and connected-up electrically in the safe. This box or case is equipped with its own shell protector 171 and destructive means 172 which comes into function automatically when the box is removed from the safe and damaged as a result of an attempt to force open the box. However, when the box is placed in the safe and connected-up electrically therein, the destructive means 172 will be triggered immediately upon activation from a processor unit 102 in the safe, whereby the protective function of the box will be subordinate to the protective function of the safe once the box 17 has been placed in said safe 1 in the manner intended.

By shell protection 101 is meant external protection which is designed so that if damaged by an externally applied force there will be activated internally a protective function causes staining of the banknotes contained or causes the banknotes to be blown to pieces or renders the banknotes unusable in some other way. The motive that lies behind a forced entry is therewith eliminated, without the safe needing to be too heavy or too difficult to handle.

The aforesaid outer shell protection may consist of safe walls that are comprised of a multilayer material which when damaged at any place thereon cause a short-circuit to occur between said layers, or when contact is broken between said layers, or the material structure is impaired in any other way, will result immediately in activation of the inner protective function. Alternative solutions may consist in providing one or more detectors that sense, e.g., changes in air pressure when the safe is opened in a manner which is not in accordance with regulations, thereby activating the protective function.

According to a further embodiment of the invention, the majority of units 11–16 of said units 11–17 are each provided with a destructive device 112–162 that includes an explosive and/or a dye or some other destructive substance (glue) for local destruction of valuable documents in respective units 11, 12 . . . 16. These devices are designed to be activated by the processor unit 102 depending on whether or not respective units contain valuable documents at that moment or are empty. In this case, destruction caused by the destructive devices 112–162 will be limited to individual units that contain valuable documents at the time at which a forced entry is attempted.

Figure 3:
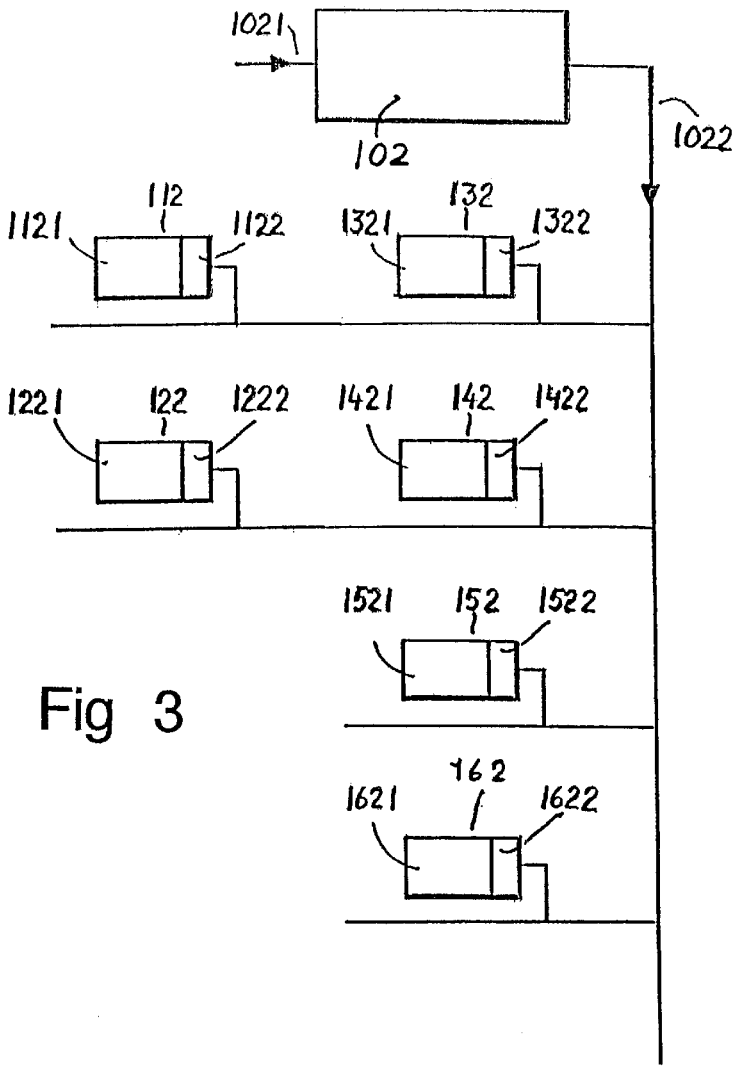
FIG. 3 is a circuit diagram illustrating destructive means included in the safe shown in FIG. 1.

The circuit diagram according to FIG. 3 includes destructive devices 112–162 which each comprise a dye part 1121–1621 and an explosive part 1122–1622. A multiconductor cable 1022 extends from the processor unit 102 controlling the destructive devices and functions to conduct firing impulses to respective explosive parts depending on the damage caused to the shell protection 101 and partly depending on whether or not respective units 11–16 contain banknotes. Information relating to access to valuable documents in respective units is delivered continuously to the processor unit 102 from the destructive devices via an input 1021.

The destructive devices are positioned with the dye part facing towards and in the close proximity of the edges of a bundle of banknotes. Each unit may include a plurality of such destructive devices.

The units 11–17 indicated in FIG. 1 may contain a plurality of valuable documents (banknotes) in accordance with the following:

The units 11–16 have two bands between which banknotes are stored such that the edges (short sides) of the banknotes project out, a wind-up drum, and two smaller unwinding drums. It is the large wind-up drum that can normally contain a large number of banknotes. Consequently, the destructive device is placed with the dye part of said device facing one end of the drum consisting of banknote-edges. One such device may optionally be placed at both ends of the drum.

The unit 17 may include disposable cassettes, made of plastic for instance, with banknotes packed tightly together therein. The destructive device is placed on the cassettes with the dye part of said device facing towards the edges of the banknotes.

Figure 2:
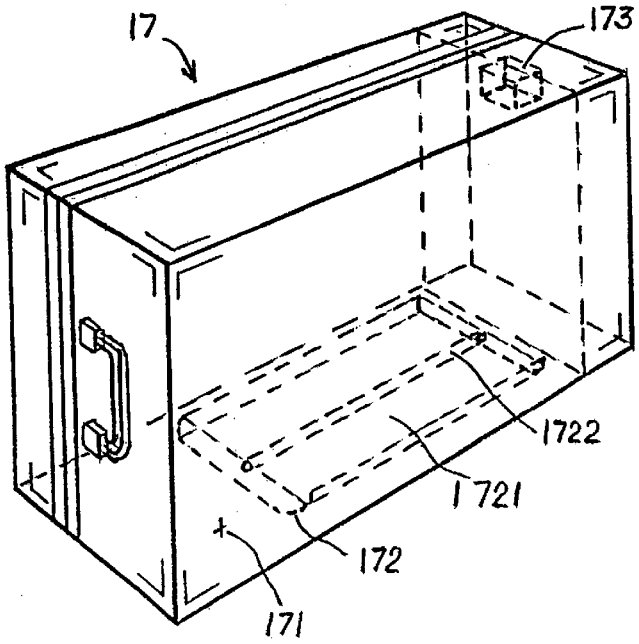
FIG. 2 illustrates one of said units in the form of a moveable box or case that can be connected-up in the safe.

The unit 17 illustrated in FIG. 2 has the form of a portable safe deposit box that is designed to enable it to be placed in the safe 1 and connected electrically to the wiring system of the safe via an electric contact device 173. The shell protection of the box (multilayer casing) is referenced 171 and its destructive device referenced 172. This device has an elongate dye part 1721 and a explosive part 1722.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A safe for valuable documents comprising:

a shell protection around said safe for impeding attempts to force an entry thereinto;

a processor unit actuated in response to damage to said shell protection to initiate an active safe protection function;

a plurality of units for accommodating documents, said plurality of units fitting within said safe; and at least one of said plurality of units including a portable safe deposit box which, when placed in said safe, can be electrically connected thereto, said safe deposit box having a protective shell and a destructive device located therein designed to actively effect local destruction of documents contained in said box, said destructive device operating automatically in response to damage to said protective shell when said safe deposit box is removed from said safe and an attempt is made to force said box open and, when said safe deposit box is placed in and electrically connected to said safe, said destructive device operating in response to actuation of said processor unit such that an active protective function of said safe deposit box is subordinated to the active protection function of said safe when said box is electrically connected within said safe.

2. The safe as set forth in claim 1, wherein a majority of said plurality of units are each provided with a destructive device that effects local destruction of documents within said units, respectively, said destructive devices being activated by signalling from said processor unit dependent upon a presence of documents within said units such that only destructive devices within units that contain documents are activated by said processor unit upon a forced entry attempt.

3. The safe as set forth in claim 1, wherein said destructive device includes one of an explosive agent and a dye.

4. The safe as set forth in claim 2, wherein each of said destructive devices includes one of an explosive agent and a dye.

5. The safe as set forth in claim 1, wherein said destructive device includes a dye part and an explosive part.

6. The safe as set forth in claim 2, wherein each of said destructive devices includes a dye part and an explosive part.

7. A safe for valuable documents comprising:

a processor unit actuated in response to an unauthorized attempt to enter said safe;

a plurality of units fitting within said safe for individually accommodating documents, each of said plurality of units including a destructive device designed to effect local destruction of documents contained within a respective unit, said destructive devices being selectively activated by said processor dependent on document presence such that only destructive devices associated with units containing documents are activated upon an attempt at unauthorized entry to said safe; and at least one of said plurality of units including a portable safe deposit box having a protective shell and a destructive device therein which, when placed in said safe, is electrically connected thereto to operate in response to said processor unit, said safe deposit box, when removed from said safe, operating automatically to activate said safe deposit box destructive device in response to damage to said protective shell.

8. The safe as set forth in claim 7, wherein each of said destructive devices includes one of an explosive agent and a dye.

9. The safe as set forth in claim 7, wherein each of said destructive devices includes a dye part and an explosive part.

10. The safe as set forth in claim 7, wherein said destructive device in said safe deposit box includes one of an explosive agent and a dye.

11. The safe as set forth in claim 7, wherein said destructive device in said safe deposit box includes a dye part and an explosive part.

* * * * *